US011078735B2

(12) United States Patent
Richard et al.

(10) Patent No.: US 11,078,735 B2
(45) Date of Patent: Aug. 3, 2021

(54) PASSIVE ROTATING JOINTED TUBULAR INJECTOR

(71) Applicant: AUTOMATED RIG TECHNOLOGIES LTD., Alberta (CA)

(72) Inventors: David Louis Richard, Alberta (CA); Harold James Miller, Alberta (CA); Ivan Amic, Alberta (CA); Christopher Jason Serran, Alberta (CA); Jason Brent Schroeder, Alberta (CA)

(73) Assignee: AUTOMATED RIG TECHNOLOGIES LTD., Calgary (CA)

( * ) Notice: Subject to any disclaimer, the term of this patent is extended or adjusted under 35 U.S.C. 154(b) by 0 days.

(21) Appl. No.: 16/647,464

(22) PCT Filed: Jan. 22, 2019

(86) PCT No.: PCT/CA2019/050078
§ 371 (c)(1),
(2) Date: Mar. 13, 2020

(87) PCT Pub. No.: WO2019/144223
PCT Pub. Date: Aug. 1, 2019

(65) Prior Publication Data

US 2020/0217154 A1 Jul. 9, 2020

Related U.S. Application Data

(60) Provisional application No. 62/622,575, filed on Jan. 26, 2018.

(51) Int. Cl.
*E21B 19/22* (2006.01)
*E21B 19/08* (2006.01)
(Continued)

(52) U.S. Cl.
CPC ..... *E21B 19/22* (2013.01); *E21B 19/08* (2013.01); *E21B 17/20* (2013.01); *E21B 19/10* (2013.01); *E21B 19/16* (2013.01); *E21B 33/068* (2013.01)

(58) Field of Classification Search
CPC ..... E21B 19/08; E21B 19/10; E21B 19/22; E21B 17/20; E21B 19/16; E21B 33/068
See application file for complete search history.

(56) References Cited

U.S. PATENT DOCUMENTS 4,515,220 A * 5/1985 Sizer ..... E21B 33/068 166/384
4,655,291 A * 4/1987 Cox ..... E21B 19/22 166/385

(Continued)

OTHER PUBLICATIONS

International Search Report issued in International Application No. PCT/CA2019/050078 dated Apr. 18, 2019.

(Continued)

*Primary Examiner* — James G Sayre
(74) *Attorney, Agent, or Firm* — Foley & Lardner LLP

(57) ABSTRACT

A passive rotating jointed tubular continuous snubbing injector is provided for moving connected, segmented oil-field tubulars axially into or out of horizontal, extended-reach oil and natural gas wells that may contain pressurized fluid or gas to complete for production, work over and service the wells, utilizing an operation commonly known as snubbing. The injector can include variable diameter gripping mechanisms that, in combination with linear drive mechanisms, can apply radial force onto and over a certain length of the tubular, of the tubular string, and onto and over a coupling or tool joint connecting tubulars together while moving the tubular string axially into or out of the well.

(Continued)

Further, the injector may rotate in response to the rotation of tubulars while the injector is moving the tubular string into or out of the well.

20 Claims, 22 Drawing Sheets

(51) Int. Cl.

| | |
|---|---|
| ***E21B 17/20*** | (2006.01) |
| ***E21B 19/10*** | (2006.01) |
| ***E21B 19/16*** | (2006.01) |
| ***E21B 33/068*** | (2006.01) |

(56) References Cited

U.S. PATENT DOCUMENTS

| | | | | |
|---|---|---|---|---|
| 5,094,340 | A * | 3/1992 | Avakov | B65G 37/005 198/604 |
| 5,360,075 | A * | 11/1994 | Gray | E21B 19/22 175/103 |
| 6,719,043 | B2 | 4/2004 | Austbo et al. | |
| 6,892,802 | B2 | 5/2005 | Kelly et al. | |
| 6,892,810 | B2 | 5/2005 | Austbo et al. | |
| 6,910,530 | B2 | 6/2005 | Austbo et al. | |
| 6,968,894 | B2 | 11/2005 | Austbo et al. | |
| 2003/0209346 | A1 | 11/2003 | Austbo et al. | |
| 2004/0159426 | A1 | 8/2004 | Austbo et al. | |
| 2004/0159427 | A1 | 8/2004 | Austbo et al. | |
| 2004/0159443 | A1 | 8/2004 | Austbo et al. | |
| 2004/0188100 | A1* | 9/2004 | Austbo | E21B 19/22 166/384 |
| 2006/0081368 | A1* | 4/2006 | Rosine | E21B 19/22 166/77.3 |
| 2015/0167405 | A1 | 6/2015 | Hickey | |

OTHER PUBLICATIONS

Written Opinion issued in International Application No. PCT/CA2019/050078 dated Apr. 18, 2019.

* cited by examiner

PASSIVE ROTATING JOINTED TUBULAR INJECTOR

CROSS-REFERENCE TO RELATED APPLICATIONS

This application is a national stage application of PCT/CA2019/050078, filed Jan. 22, 2019, which claims priority of U.S. Provisional Patent Application No. 62/622,575 filed Jan. 26, 2018, which are incorporated by reference into this application in their entirety.

TECHNICAL FIELD

The present disclosure is related to the field of injecting pipe or tubing into a well, in particular, systems and methods for continuously pushing, forcing, snubbing or stripping a tubular string into or controlling when pulling or resisting the movement of a tubular string out of pressurized and/or horizontal well bores.

BACKGROUND

In recent years, new technologies have been introduced that have increased the industry's ability to drill oil and gas wells horizontally to great measured lengths. Conventional vertical or directional oil or gas completion, work over and service rigs primarily use the force of gravity to move drilling, completion, work over and service tools to the full measured length of the oil or gas wells to complete, work over or service the wells. When horizontal wells are drilled such that the horizontal section is longer than the length of the vertical section, it becomes difficult to move the tools to the end of the well for the purpose of completing, working over or servicing the well including the drilling and removing of fracturing ("fracing") plugs. The well may also contain well bore pressures when the tools are being introduced into or removed from the wellbore, creating a need to force the tools into the wellbore against that pressure until such point that the weight of the oil field tubular string overcomes the force of the wellbore pressure against it, or to resist the force exerted on the tools and pipe by the wellbore pressure forcing the tools from the wellbore.

It has been found that cuttings and debris tend to collect in the lower side of the horizontal well sections and that pipe string rotation helps to distribute the debris and cuttings into the annular area to help the circulating fluid to carry it out of the wellbore.

The industry has commonly used continuous coiled tubing injector technology or segmented oil field tubular snubbing jack technology to complete, work over and service the oil and natural gas wells under pressure.

Limitations have been realized when utilizing continuous coiled tubing injector technology as the horizontal sections get longer. Limiting factors of coiled tubing are transportability to get to the well sites and the ability to push the continuous pipe in the extended reach horizontal section of the oil or natural gas wells. Transportation is a limitation because the tubing cannot be divided into multiple loads. A practical mechanical limitation of pushing the coiled tubing into the well exists when the friction in the horizontal section of the wellbore exceeds the buckling force limit of the continuous tubing. Due to the inherent requirement to be stored on a storage reel, coiled tubing cannot be rotated in order to reduce friction while moving axially and to stir cuttings and debris from the lower side of the wellbore into the annular area where circulating fluid can carry it up-hole.

Another method of forcing segmented oil field tubulars into a wellbore is to use what is commonly known as hydraulic snubbing jack technology. Generally, a snubbing jack consists of stationary slips and travelling slips that are connected to hydraulic cylinders to push sections of the pipe repetitively into the wellbore by taking multiple strokes of various lengths. The force that a snubbing jack can apply is limited because the distance between the stationary slip and the travelling slip creates an unsupported column length of the oil field tubular that increases the risk of buckling the tubular. Due to the constant start and stop repetitive movements of using a snubbing jack to move the pipe, it is difficult to circulate fluid through the pipe while moving. The repetitive movements of the snubbing jack are operated manually up to thousands of times per well that is being serviced creating the high possibility of human error resulting in an operational safety risk.

There is a demonstrated need in the industry to rotate a tubular string while pushing, forcing, snubbing or stripping into or controlling when pulling while resisting wellbore pressures, a tubular string out of wells that may be under pressure to reduce the friction of axially moving the tubular string in extended reach horizontal wells to overcome the limitations of continuous coil tubing injector technology.

There is a further demonstrated need in the industry to reduce or eliminate the risk of buckling or bending an unsupported length of a tubular string being forced into a well under pressure.

There is further a demonstrated need in the industry to automate the operation of forcing or snubbing of the tubular string into or out of wells under pressure to overcome the safety risks of thousands of repetitive manually controlled movements of the snubbing jack technology.

It is, therefore, desirable to provide a system and method that addresses these demonstrated needs.

SUMMARY

A system and method for injecting pipe or tubing into a well is provided. In some embodiments, the system can comprise a passively rotating jointed tubular string continuous snubbing injector ("injector") that can continuously apply a linear force into the tubular string while allowing the continuous rotation of a tubular string into and out of extended reach horizontal wellbores for the purposes of completing, working over and servicing the wells.

In some embodiments, the injector can minimize the unsupported length of a tubular or tubular string by maintaining minimal and constant distance between the grippers of the injector that are gripping the tubular and the Blow Out Preventer (hereinafter called the "BOP") as the injector applies axial force to the tubular string into, or pulls the tubular string out of, the BOP and wellbore, thereby overcoming the limitations of the snubbing jack technology.

In some embodiments, the injector can comprise a mechanism that can apply a linear, constant force through the grippers onto and over a certain length of the tubular and onto and over a certain length of a larger diameter coupling or tool joint connecting the segments of tubulars together while moving the tubulars axially into or out of the well and allowing simultaneous rotation of the tubular.

In some embodiments, the rotational force caused by the tubular string rotating can be transferred through the gripper mechanisms of the injector to the driven chains connected to the grippers, and then to a stationary structure supporting and containing the injector, thereby minimizing rotational forces applied to the well head.

In some embodiments, the stationary structure supporting and containing the injector can provide further support for the weight of the tubular string suspended in the wellbore when that tubular string is held by pipe slips supported within the uppermost part of the stationary structure.

Broadly stated, in some embodiments, a tubing injector can be provided for pushing or pulling a tubular string axially into or out of a well, the tubular string comprising a plurality of oil field tubulars connected together with tubular connecting elements, the tubular connecting elements having a larger diameter than the tubulars, the injector comprising: a housing structure; a plurality of gripper block assemblies attached to at least two drive chains, the at least two drive chains substantially parallel to each other and rotatably disposed in the housing structure, the plurality of gripper block assemblies configured to make contact with and apply force to the tubular string; at least one motor operatively connected to the at least two drive chains, the at least two drive chains position in a spaced-apart configuration to create a passageway for the tubular string to pass therethrough; at least two pressure plates or beams each operatively connected to at least two hydraulic cylinders, the at least two pressure plates or beams configured to impart a transverse force on the at least two drive chains when the at least two hydraulic cylinders are engaged thereby causing the plurality of gripper block assemblies to grip the tubular string; and a plurality of rolling elements disposed between the at least two drive chains and the at least two pressure plates, whereupon operation of the at least one hydraulic motor urges the at least two drive chains to move, thereby causing the tubular string to move axially into or out of the well when the plurality of gripper block assemblies are applying force to the tubular string.

Broadly stated, in some embodiments, the at least one motor can comprise a hydraulic motor.

Broadly stated, in some embodiments, the at least one motor can comprise one or more hydraulic motors operatively coupled to each of the at least two drive chains.

Broadly stated, in some embodiments, the housing structure can be configured to translate a static axial force from an upper portion of the housing structure to a bottom mounting plate of the housing structure.

Broadly stated, in some embodiments, the injector can be mounted within an outer support structure comprising roller bearing elements, wherein the injector is configured to rotate with the tubular string.

Broadly stated, in some embodiments, the plurality of gripper block assemblies and the at least two drive chains can be configured for passive rotation of the injector within the outer support structure.

Broadly stated, in some embodiments, the injector mounting structure can be further mounted within an outer support structure housing that comprises a hydraulic rotary fluid swivel configured for the transfer of hydraulic fluids to the injector.

Broadly stated, in some embodiments, the outer support structure can be configured to translate a static axial force from an upper portion of the outer support structure to a bottom mounting plate of the outer support structure.

Broadly stated, in some embodiments, the at least two hydraulic cylinders can be configured to move the at least two pressure plates or beams towards and away from each other wherein the distance therebetween decreases and increases to accommodate the tubulars and the tubular connecting elements passing therethrough.

Broadly stated, in some embodiments, the tubular connecting elements can comprise one or both of tubular couplers and tool joints.

Broadly stated, in some embodiments, the gripper block assemblies can be disposed in a gripper block assembly configured to impart radial and axial force to the tubulars and the tubular connecting elements.

Broadly stated, in some embodiments, each of the plurality of gripper block assemblies can comprise: a pair of gripper blocks rotatably disposed in a housing further comprise of two housing halves; a pair of eccentric shafts rotatably disposed in the housing wherein each of the pair of gripper blocks is rotatably disposed on an eccentric shaft; and a spring disposed on each of the pair of eccentric shafts configured to bias each of the eccentric shafts to a starting position.

Broadly stated, in some embodiments, each of the plurality of gripper block assemblies can further comprise a guide pin disposed on each of the pair of gripper blocks, the guide pin configured to move along a cam profile disposed on each of the two housing halves.

Broadly stated, in some embodiments, each of the gripper block assemblies can further comprise a stopper face disposed on each of the eccentric shafts and a stop disposed in each of the two housing halves, wherein the stopper face is configured to contact the stop.

DETAILED DESCRIPTION OF EMBODIMENTS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1A:
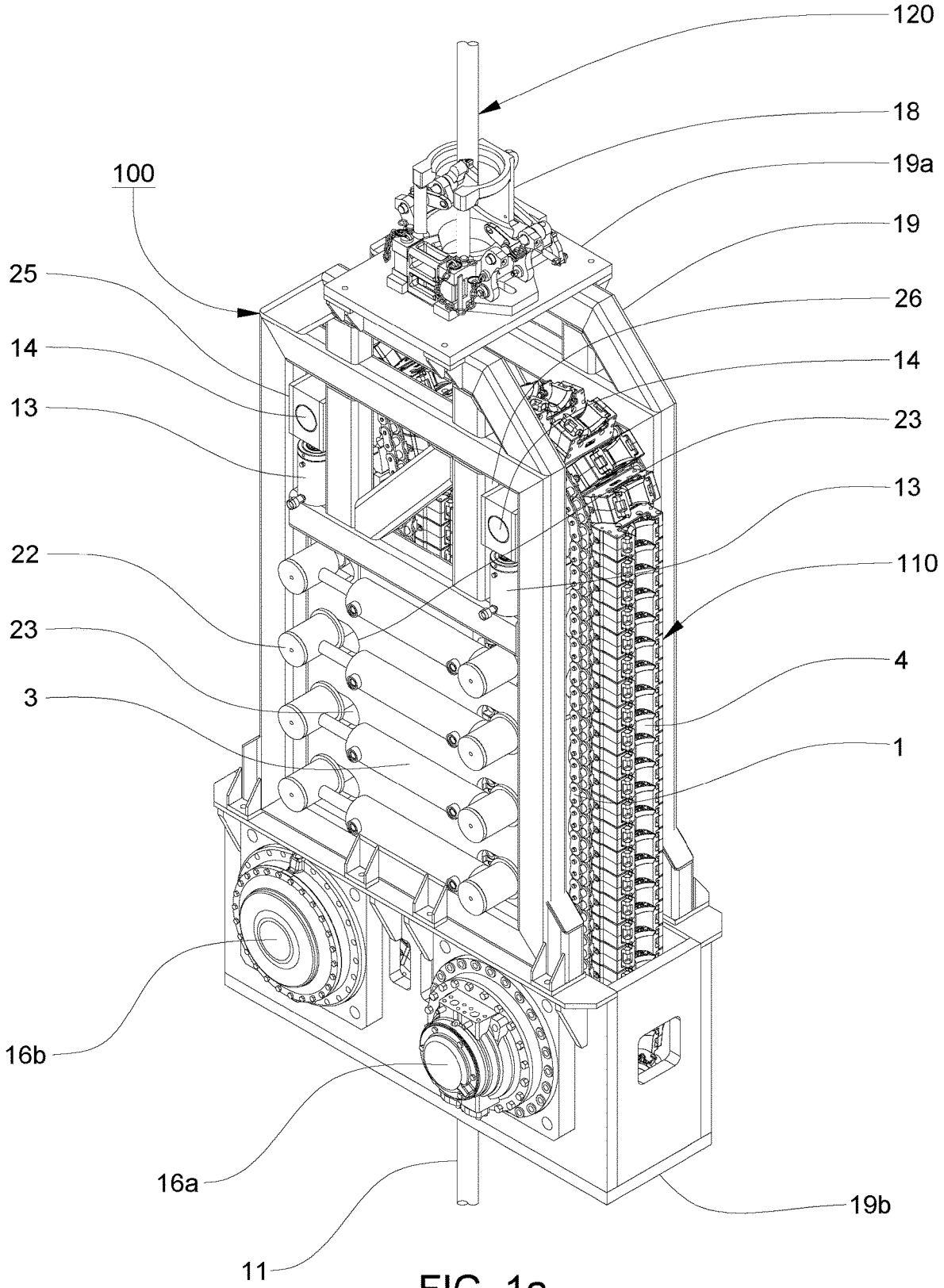
FIG. 1*a* is an isometric view depicting an injector assembly, further depicting the injector, chains, drives, grippers, tensioners, and supporting structure of the injector.

Referring to FIG. 1*a*, FIG. 1*a* refers to injector (100). In some embodiments, drive chain links (1), and gripper block assemblies (4) can be interconnected to form two continuous counter-rotating chain assemblies (110). Each chain assembly (110) can be driven by motor (16*a*) or held stationary by brake (16*b*). Gripper block assemblies (4) can be attached to drive chain links (1) that can be acted upon by a plurality of squeeze cylinders (3) that can apply a transverse force to cause the counter-rotating drive chain assemblies (110) to move towards each other thereby forcibly engaging gripper block assemblies (4) with the outer diameter of tubing (11) and the larger outer diameter of a coupling, tool joint or other connecting element connecting segments of tubular string (120). In some embodiments, the squeeze cylinders (3) act upon pressure beam shafts (22) that pass through the ends of the squeeze cylinders (3), slotted holes (23) disposed on housing structure (19) and pressure beams (2). In some embodiments, chain tension hydraulic cylinders (13) can apply vertical force to idler sprocket shaft (14) to adjust the drive chain length as the chain components wear or as the diameter of tubing (11) or tubing coupler (12) varies in diameter. The tensioner shafts [JJH—what are these in the figures?] are guided vertically by sliders (25) moving within slots (26) in the housing structure (19). [JJH—slots 26 are not really visible in figure]. In some embodiments, housing structure (19) can be comprised of structural metal tubing, as well known to those skilled in the art, further comprising an upper portion (19*a*) and a bottom mounting plate (19*b*).

Figure 1B:
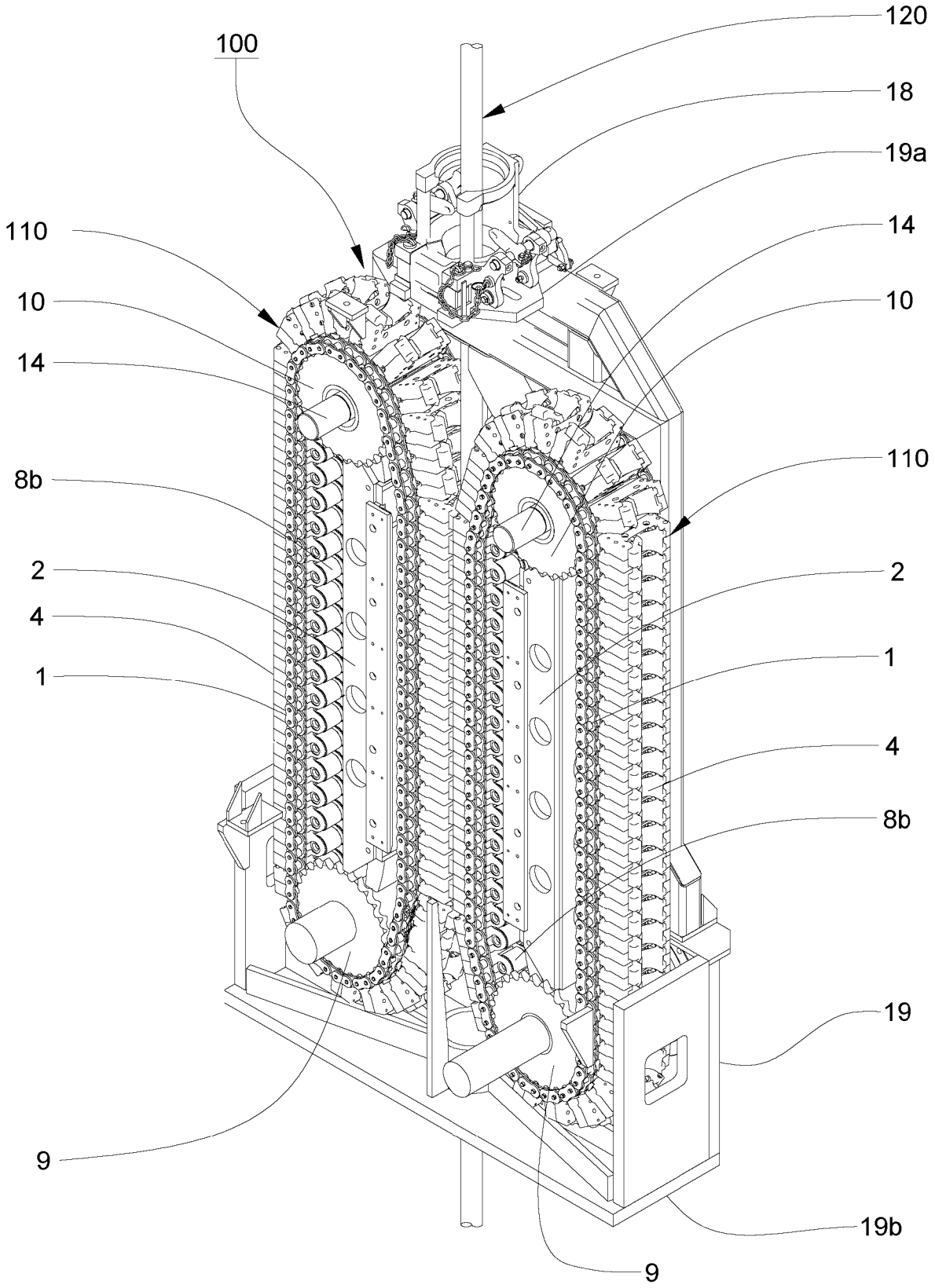
FIG. 1*b* is an isometric view depicting the injector assembly of FIG. 1*a* with part of the outer housing removed to allow a view of the internal workings.

FIG. 1*b* is an isometric view of the injector of FIG. 1*a* with part of housing structure (19), squeeze cylinders (3), one motor (16*a*) and one brake (16*b*) removed to expose the inner workings of injector (100). Chain assemblies (110) can be engaged on drive sprocket assemblies (9) at the bottom of the assembly, and on idler sprockets (10) rotatably disposed on idler sprocket shafts (14) at the top of the assembly. Idler sprockets (10) can move vertically to maintain chain tension as pressure beams (2) are acted upon by squeeze cylinders (3) In some embodiments, gripper block assemblies (4) can be supported by rolling elements (8*b*) that can be acted upon by hydraulic cylinder pressure beams (2) to force counter-rotating chain assemblies (110) towards each other, and to force gripper block assemblies (4) onto tubular string (120). In some embodiments, injector (100) can be contained within main housing (19) that can be mounted to a wellhead, lubricator, or BOP supplied by others. In some embodiments, slip support structure (18) can be installed on top of the main housing (19) to provide a method of supporting tubular string (120) when it is not supported by injector (100), or by another structure. In some embodiments, main housing (19) can be configured structurally to support the weight of injector (100) and tubular string (120) when mounted on top of the wellhead, lubricator or BOP.

Figure 2:
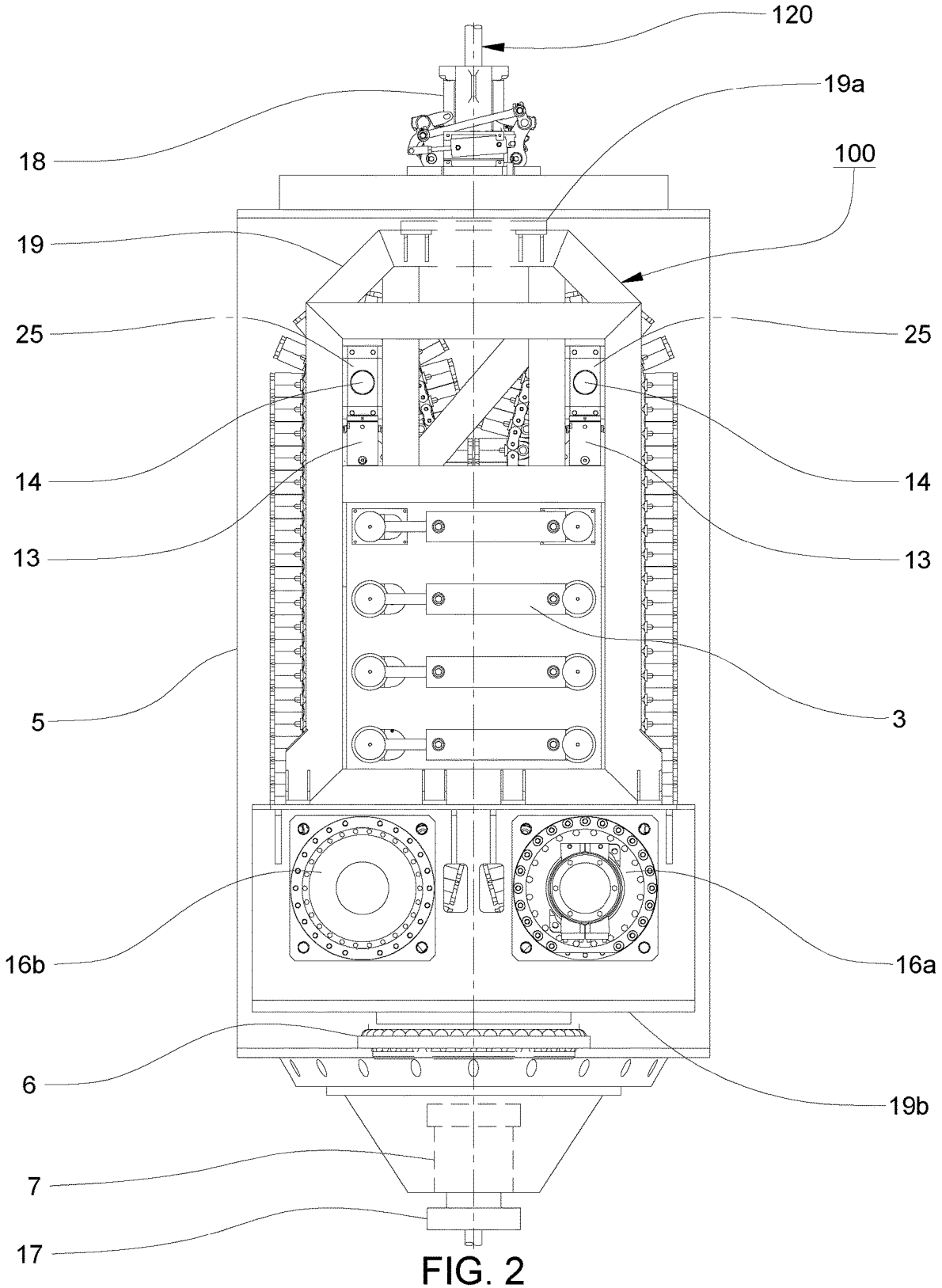
FIG. 2 is a front elevation cross-section view depicting an injector assembly of FIG. 1 mounted within an outer housing, further depicting the injector supported by a bearing assembly and an outer housing and a rotary seal assembly.

In some embodiments, injector (100) can be mounted within outer support structure (5), as shown in FIG. 2. In some embodiments, injector (100) can be contained within main housing (19) that can be rotatably mounted on bearings (6) within outer support structure (5). Pressurized hydraulic fluid can be ported through rotary fluid swivel (7) and into hydraulic squeeze cylinders (3), hydraulic drive motors (16*a*), hydraulic brakes (16*b*) and chain tension cylinders (13). Outer support structure (5) can be supported on mounting flange (17) attached to a wellhead, lubricator, or BOP supplied by others. In some embodiments, slip support structure (18) can be installed within the uppermost area of outer support structure (5) to provide a method of supporting tubular string (120) when it is not supported by injector (100), or by another structure. In some embodiments, outer support structure (5) can be configured structurally to support the weight of injector (100) and tubular string (120) when mounted on top of the wellhead, lubricator or BOP.

Figure 3:
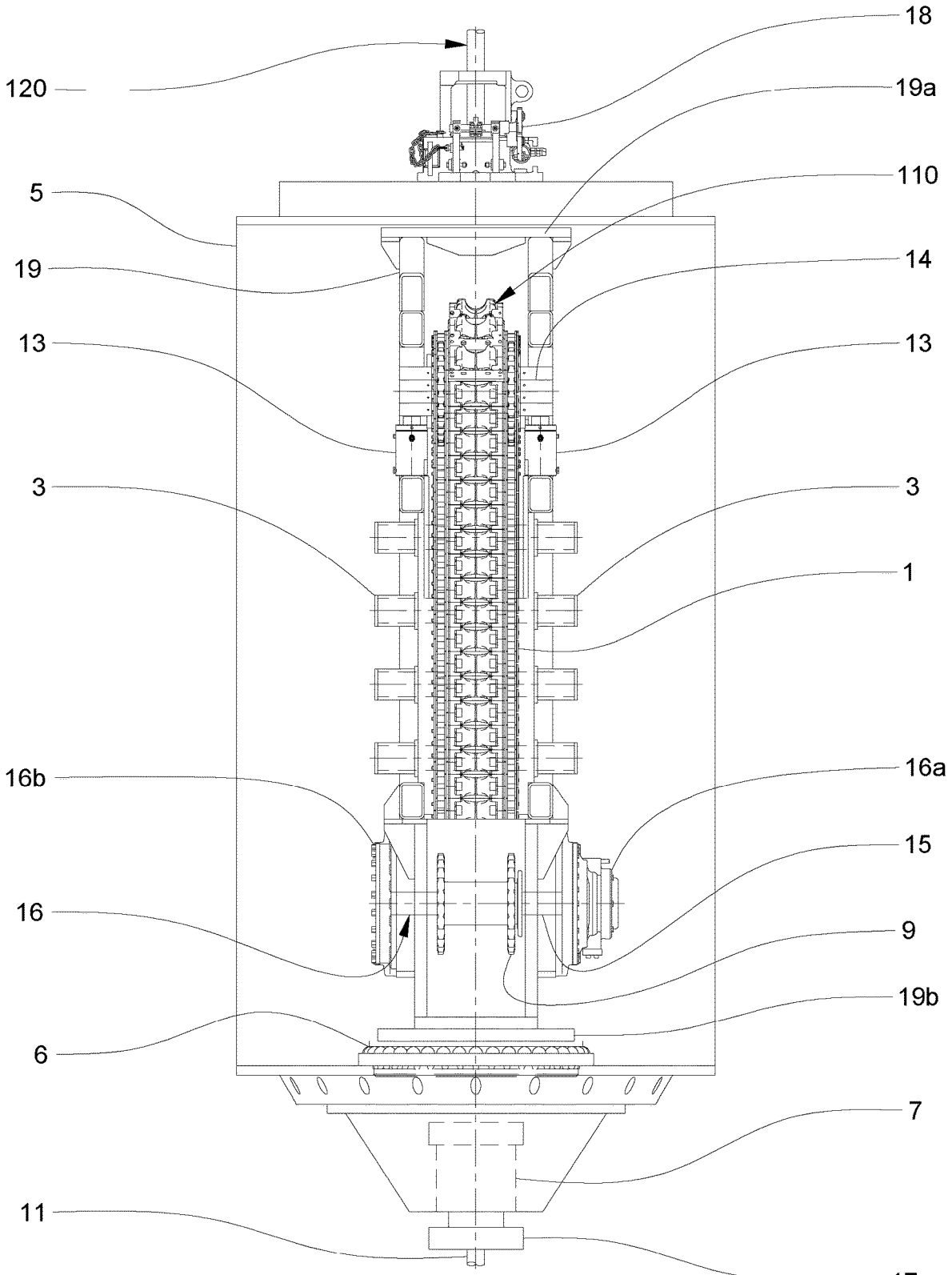
FIG. 3 is a side elevation cross-section view depicting the injector of FIG. 2, further depicting the injector, chain drives, and supporting structure of the injector.

FIG. 3 illustrates a side elevation view of the injector showing hydraulic motor assemblies (16), comprised of hydraulic drive section (16*a*) and hydraulic brake section (16*b*), and coupled to drive sprocket shafts (15), which can apply rotational force and speed to drive sprockets (9) to drive chain assemblies (110) and chain links (1) (as shown in FIG. 1). In some embodiments, chain tension hydraulic cylinders (13) can apply vertical force to idler sprocket shaft (14) to adjust the drive chain length as the chain components wear or as the diameter of tubular string (120) varies in diameter.

Figure 4:
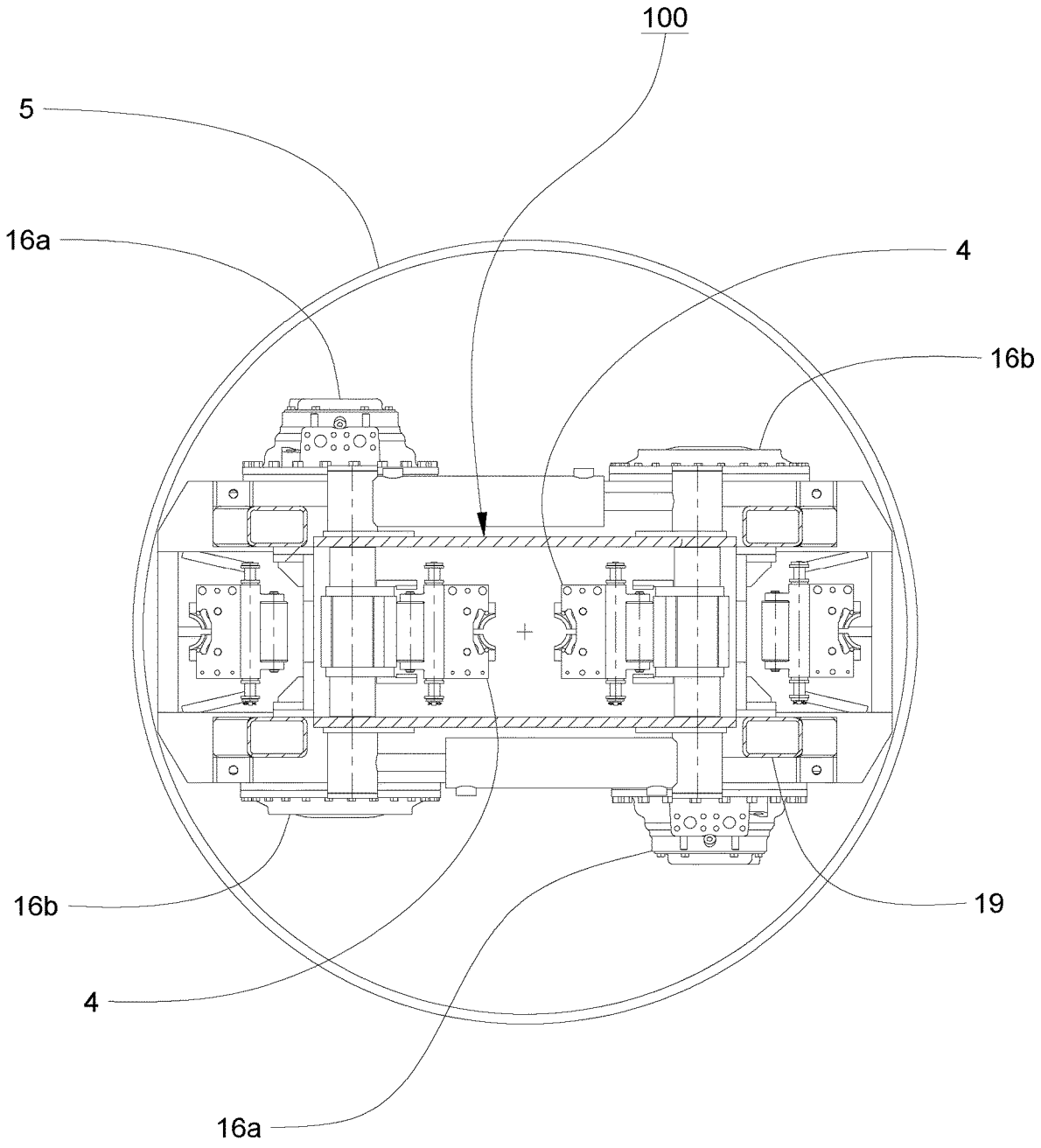
FIG. 4 is a top plan section view depicting the hydraulic motor assemblies, squeeze cylinder assembly and the grippers of the injector of FIG. 2.

FIG. 4 illustrates a top plan section view of injector (100) showing gripper block assemblies (4) at a stand-by position to create a larger opening between the chain assemblies for downhole tools or wellhead components to be passed through. The fitment of main housing (19) and drive motors (16) are shown in relation to outer support structure (5) to illustrate how injector (100) can rotate within outer support structure (5).

Figure 5A:
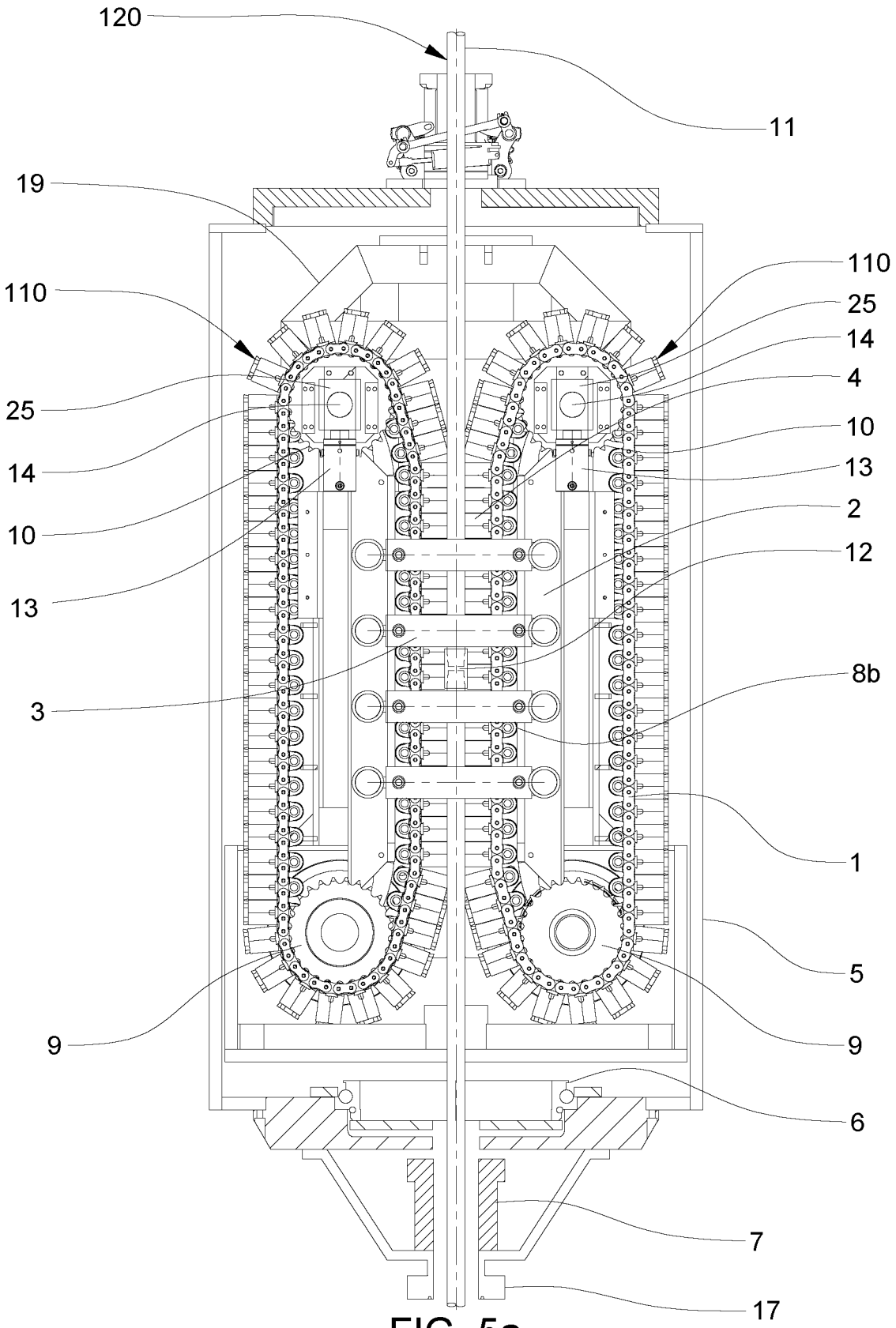
FIG. 5*a* is a front elevation view depicting the injector, grippers, chain drives, and supporting structure of the injector of FIG. 2 in an operating mode of operation.

FIG. 5*a* illustrates a front elevation section view that shows the hydraulic squeeze assembly, consisting of pressure beam (2), rolling elements (8*b*), and hydraulic squeeze cylinders (3) retracted in order to cause drive chain links (1) and gripper block assemblies (4) to engage the outer diameter of tubing string (11) and the larger outer diameter of a coupling, a tool joint or another connecting element, labelled as (12) in the figure, connecting segments of tubular string (120) in an operating mode. Chain tension cylinders (13) can retract to maintain tension on chain assemblies (110) as squeeze cylinders (3) retract to pull grippers (4) towards each-other in order to engage tubular string (120).

Figure 5B:
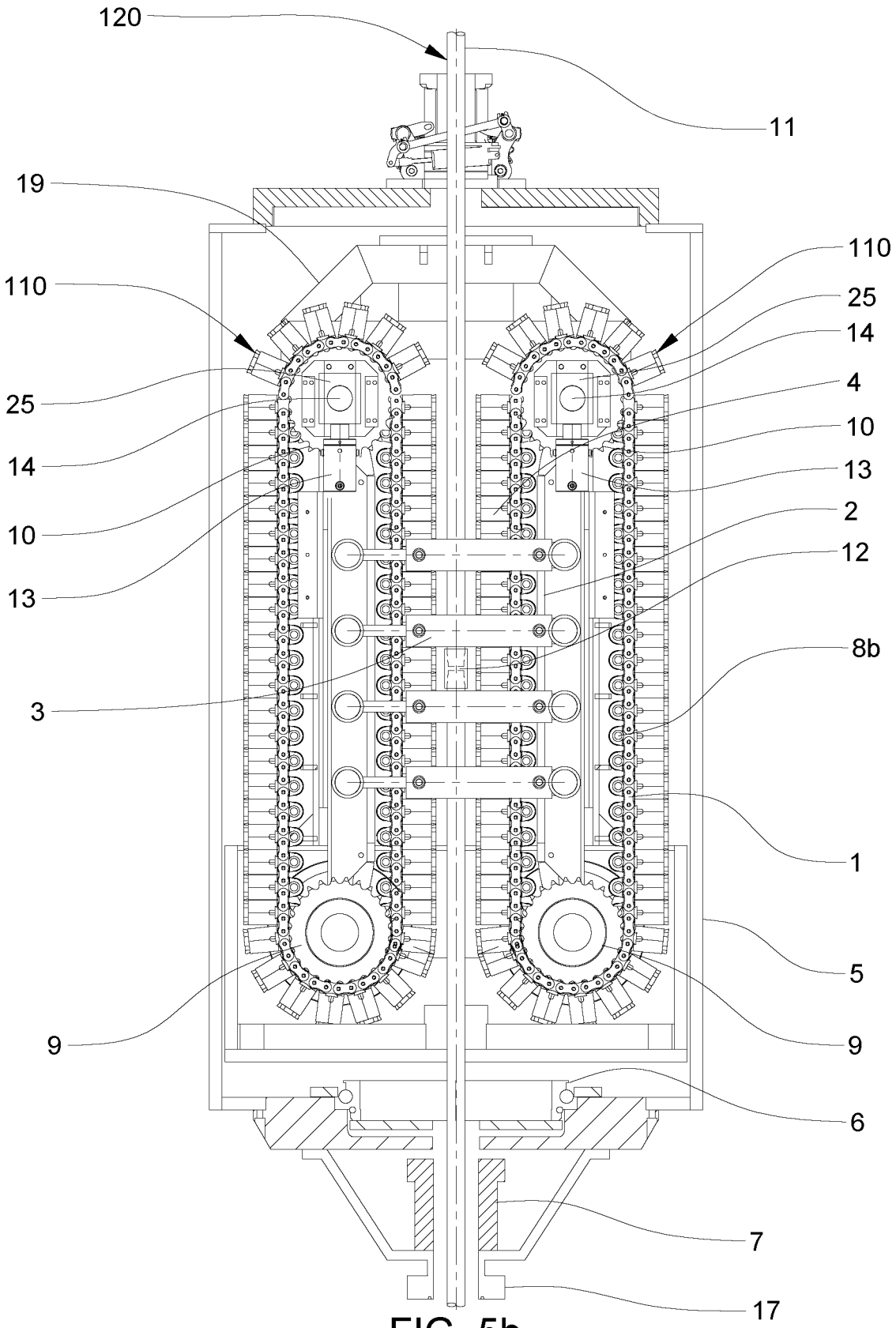
FIG. 5*b* is a front elevation view depicting the injector, grippers, chain drives, and supporting structure of the injector of FIG. 2 in a standby mode of operation.

FIG. 5*b* illustrates a front elevation section view that shows the hydraulic squeeze assembly, consisting of hydraulic pressure beam (2), rolling elements (8*b*), and hydraulic squeeze cylinders (3) extended in order to cause drive chain links (1) and gripper block assemblies (4) to dis-engage the outer diameter of tubing (11) and the larger outer diameter of a coupling, a tool joint or another connecting element, labelled as (12) in the figure, connecting segments of tubular string (120) in a non-operating, stand-by operating mode. Chain tension cylinders (13) can extend to maintain tension on chain assemblies (110) as squeeze cylinders (3) extend to push grippers (4) away from each-other in order to dis-engage tubular string (120).

Figure 6:
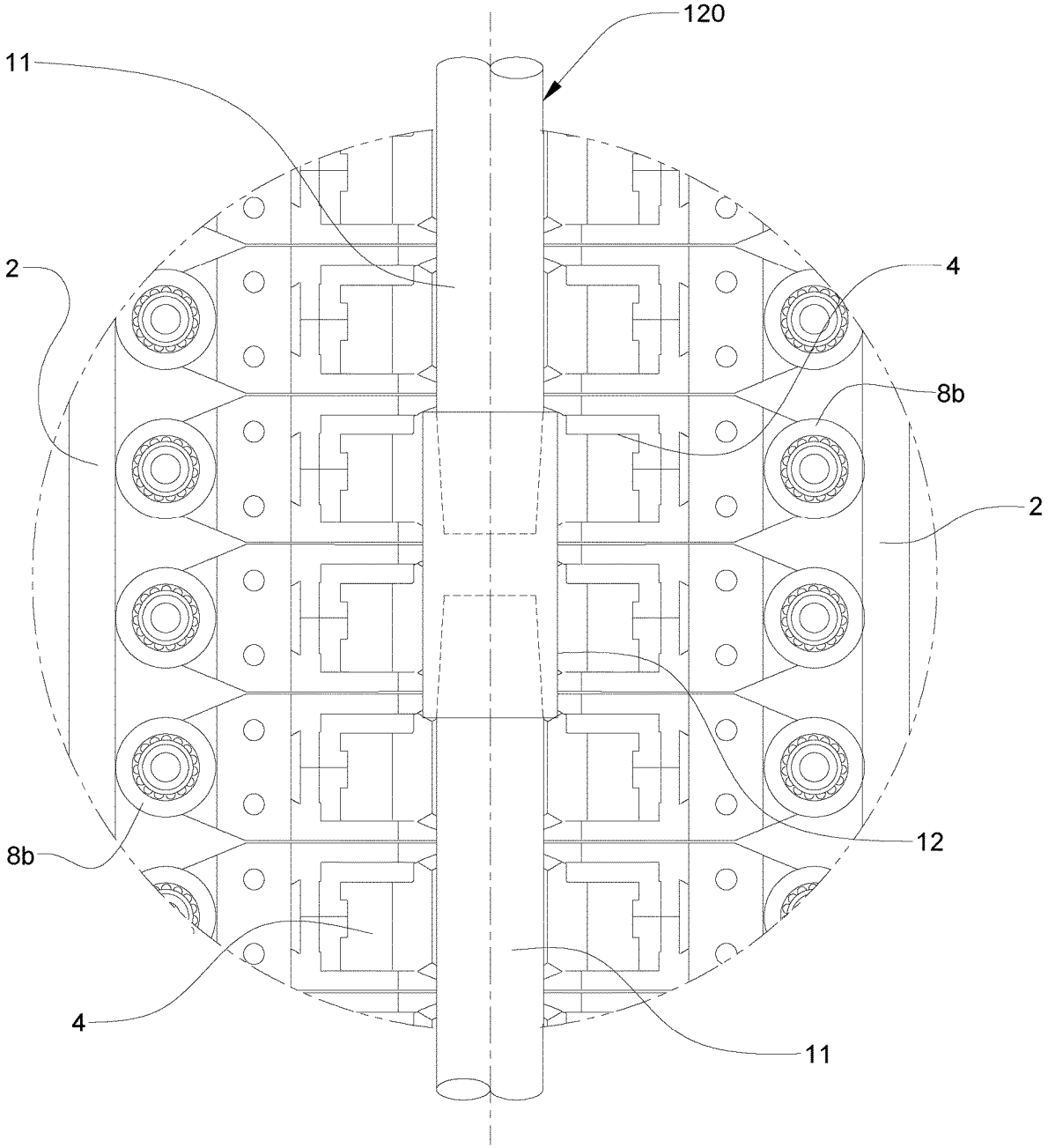
FIG. 6 is a side elevation view depicting the injector of FIG. 1 gripping a section of a tubular string comprising a tubing coupler.

Referring to FIG. 6, gripper block assemblies (4) are shown in an operating mode wherein gripper block assemblies (4) are in contact with and engaging the outer diameter of tubing (11) and the larger outer diameter of coupler (12), which for the purposes of this description can comprise a tubing coupler, a tool joint or other type of tubular connecting element as well known to those skilled in the art for connecting segments of tubular string (120). In some embodiments, gripper block assemblies (4) can be supported by rolling elements (8*b*) that can be in rolling contact with hydraulic pressure beams (2). In some embodiments, gripper block assemblies (4) can variably adjust to the larger diameter of coupler (12) connecting the segments of tubular string (120) while rolling elements (8*b*) can remain in the same plane and have evenly distributed force on pressure beam (2) in order to maintain constant force on tubular string (120).

Figure 7A:
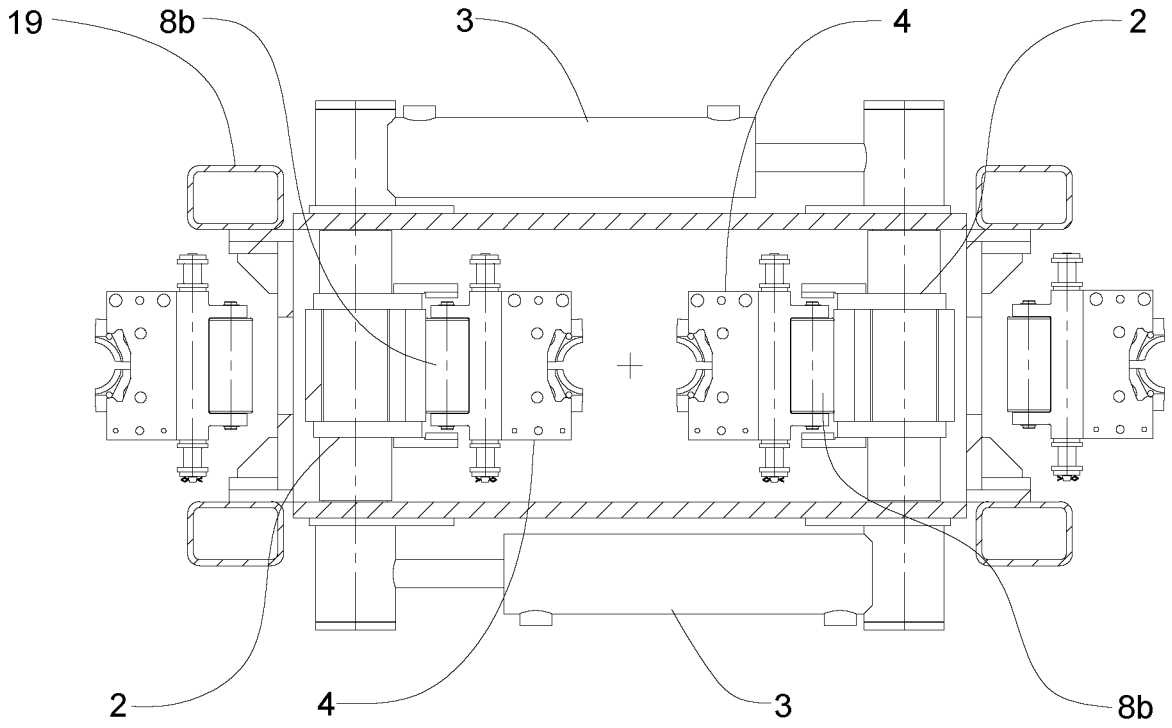
FIG. 7*a* is top plan view depicting the gripper block assemblies of the injector of FIG. 1*a* in a standby mode of operation.
Figure 7B:
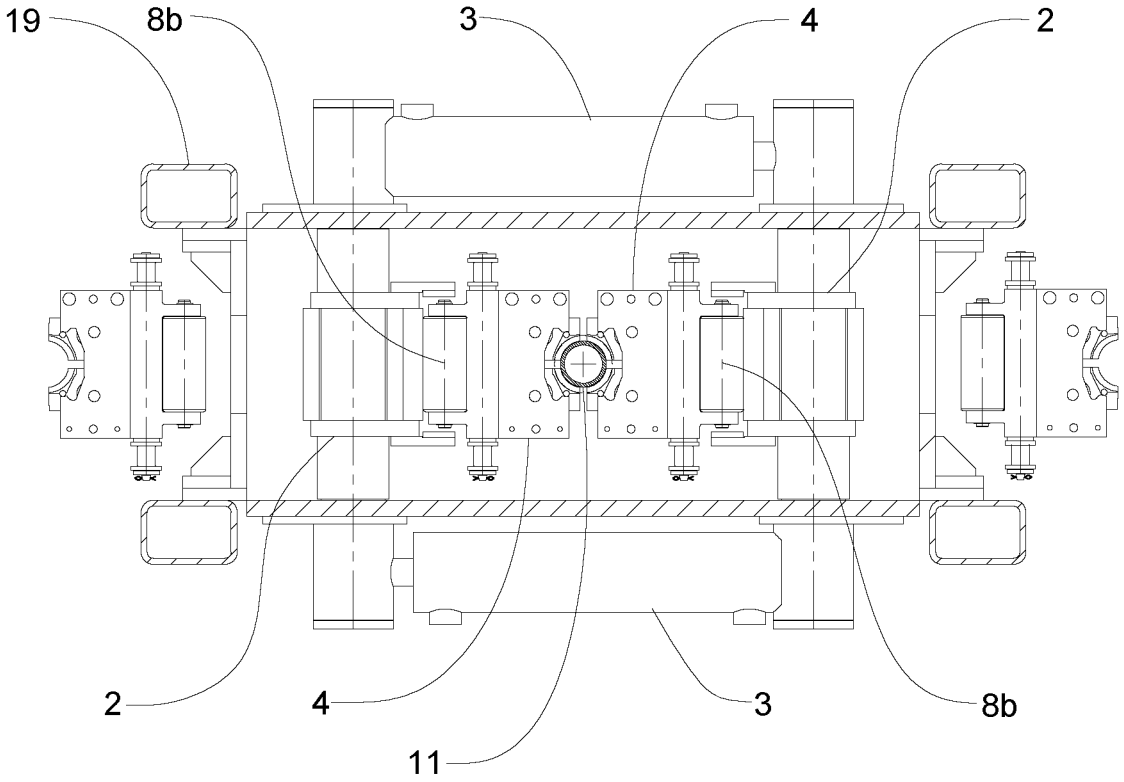
FIG. 7*b* is top plan view depicting the gripper block assemblies of the injector of FIG. 1*a* in an operating mode of operation when operating on tubing.
Figure 7C:
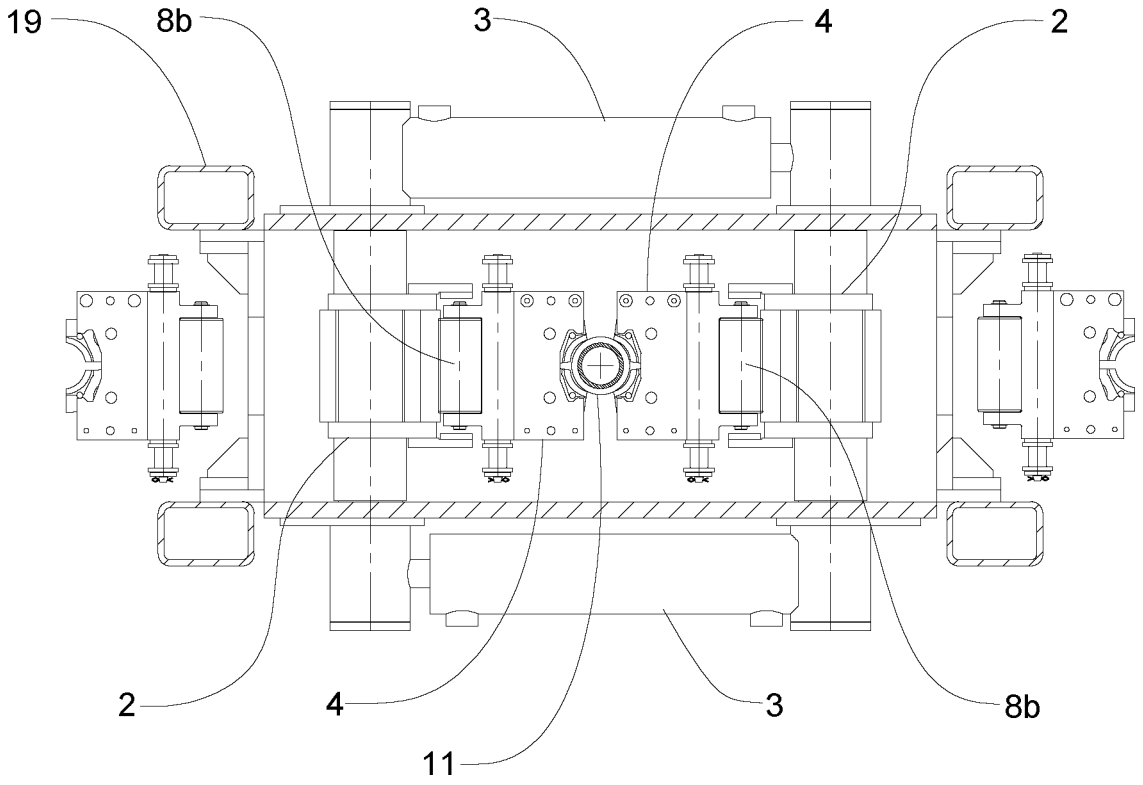
FIG. 7*c* is top plan view depicting the gripper block assemblies of the injector of FIG. 1*a* in an operating mode of operation when operating on a tubing coupler.

Referring to FIG. 7*a*, gripper block assemblies (4) are shown positioned within main injector housing (19) to a stand-by position with the squeeze cylinders (3) fully extended that can create a pathway for downhole tools or wellhead components to be passed through. In FIG. 7*b*, gripper block assemblies (4) are illustrated to be positioned within main injector housing (19) in an operating mode with squeeze cylinders (3) retracted, causing pressure beams (2) to act upon rolling elements (8*b*) of gripper block assemblies (4), wherein gripper block assemblies (4) can be engaged onto tubing (11). In FIG. 7*c*, gripper block assemblies (4) are illustrated to be positioned within main injector housing (19) in an operating mode in which gripper block assemblies (4) can be engaged on coupler (12) connecting the segments of tubular string (120).

Figure 8:
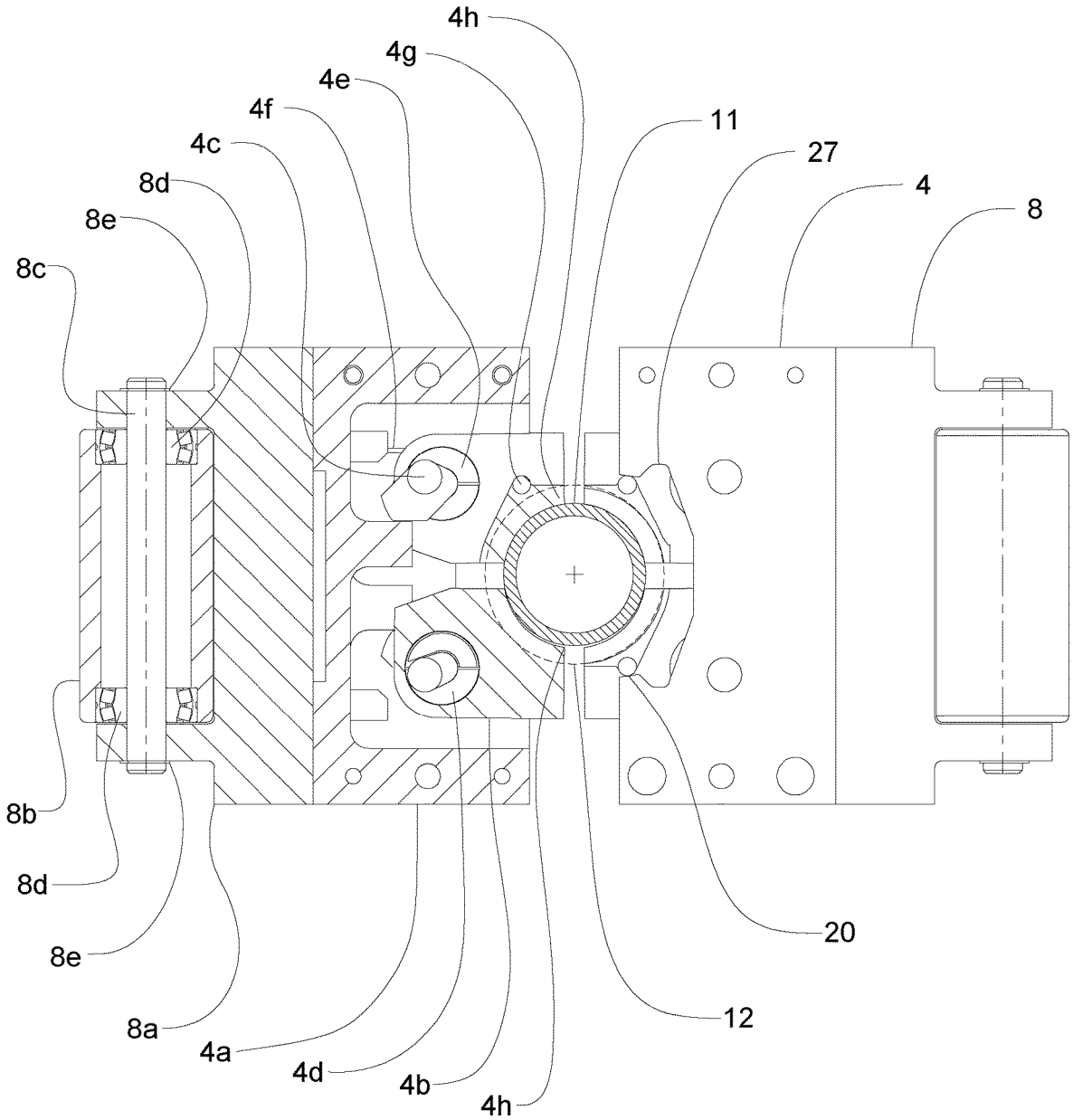
FIG. 8 is a top plan view depicting the gripper block of the injector of FIG. 1*a* or FIG. 2 on a tubular.

FIG. 8 shows a detailed view of one embodiment of gripper block assembly (4) and carrier assembly (8). In some embodiments, carrier assembly (8) can comprise carrier body (8*a*), roller (8*b*) rotatably disposed on shaft (8*c*) via bearings (8*d*) wherein shaft (8*c*) can be retained in carrier body (8*a*) with retaining rings (8*e*) disposed on one or both ends of shaft (8*c*). In some embodiments, gripper block assembly (4) can comprise of two gripper blocks (4*b*) that can be connected to eccentric shaft (4*c*) with split bushings (4*d*) and (4*e*). Eccentric shaft (4*c*) can rotate inside of each of the two housing halves (4*a*), which can be bolted together. In some embodiments, there is an guide pin (4*g*) that can go inside each gripper block (4*b*) that can contact the housing halves (4*a*) at a protruding surface (20) to act as a pivot point and force eccentric shaft (4*c*) to rotate when coupler (12) contacts outer corners (4*h*) of gripper blocks (4*b*), which can move gripper block (4*b*) out of the way of coupler (12). As gripper block (4*b*) moves away from coupler (12), the shape of eccentric shaft (4*c*) causes guide pin (4*g*) to follow the profile of housing (4*a*) until it reaches cavity (27) which causes gripper blocks (4*b*) to move away from each-other creating a space for coupler (12) while the rest of gripper block assembly (4) and carrier assembly (8) to stay in line. In some embodiments, there can be spring (4*f*) that can act as a biasing means on each eccentric shaft (4*c*) to return each gripper block (4*b*) to its starting position within gripper block assembly (4) when coupler (12) is no longer in contact with gripper block (4*b*). In some embodiments, carrier assembly (8) and gripper block assembly (4) can be connected through mechanical means. In some embodiments, the mechanical means can comprise dovetail means wherein gripper block assembly (4) and carrier assembly (8) can slide together or apart, as shown in more detail in FIGS. 10, 11*b* and 11*c* and described in greater detail below.

Figure 9A:
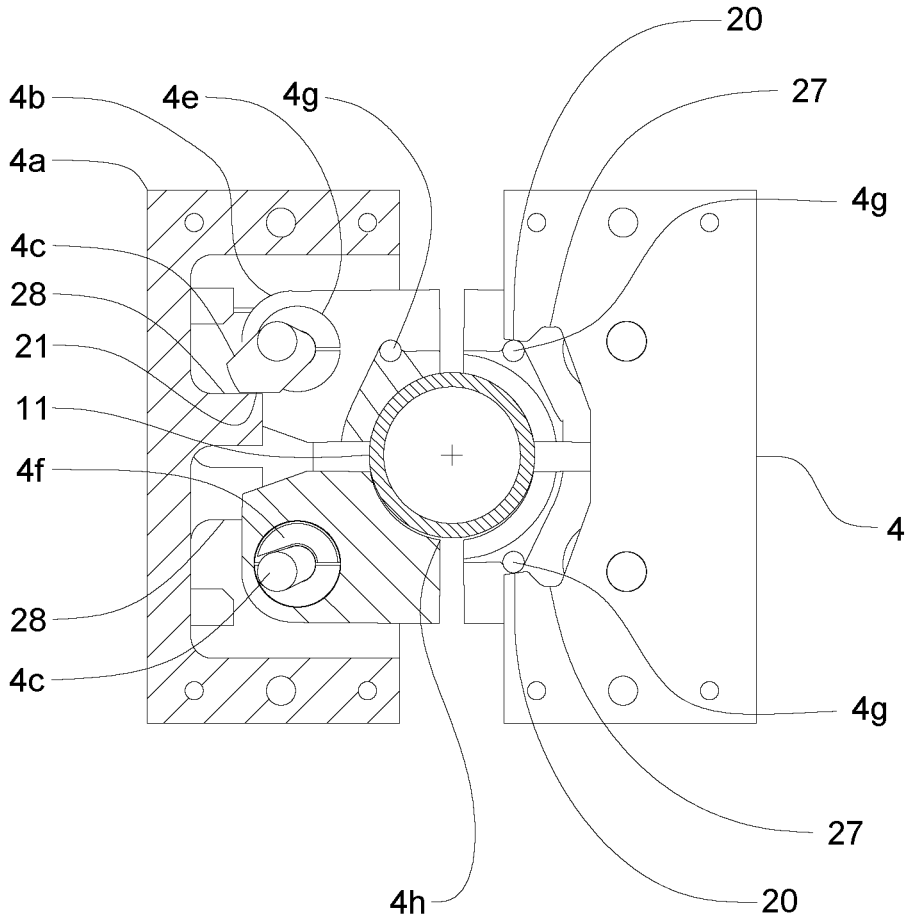
FIG. 9*a* is a top plan partial section view depicting the gripper block of the injector of FIG. 1*a* or FIG. 2 when tubing is contacted by a gripper block assembly.

FIGS. 9*a* to 9*f* shows a series of views of gripper block assembly (4) that illustrate various opening modes. FIG. 9*a* illustrates tubing (11) being contacted by gripper block assembly (4). In this figure, gripper block assembly (4) is being pushed towards tubing (11) thereby providing radial force (grip) that, in turn, allows axial force to be applied to tubing (11). Gripper blocks (4*b*) can self-centralize against tubing (11). These gripping forces are transmitted through eccentric shaft (4*c*) and create a rotation that is resisted by stopper face (21) of eccentric shaft (4*c*) making contact with stop (28) disposed in housing half (4*a*). In some embodiments, stop (28) can be integral to housing half (4*a*) as a structural feature when housing half (4*a*) is cast or manufactured. Stop (28) can limit the distance gripper block (4*b*) can move and can prevent eccentric shaft (4*c*) from rotating too far and lock up thereby preventing gripper block (4*b*) from returning its starting position. In this particular embodiment, stopper face (21) can be part of eccentric shaft (4*c*) and can act against housing half (4*a*), although those skilled in the art will appreciate that various alternative configurations exist that are substantially similar.

Figure 9B:
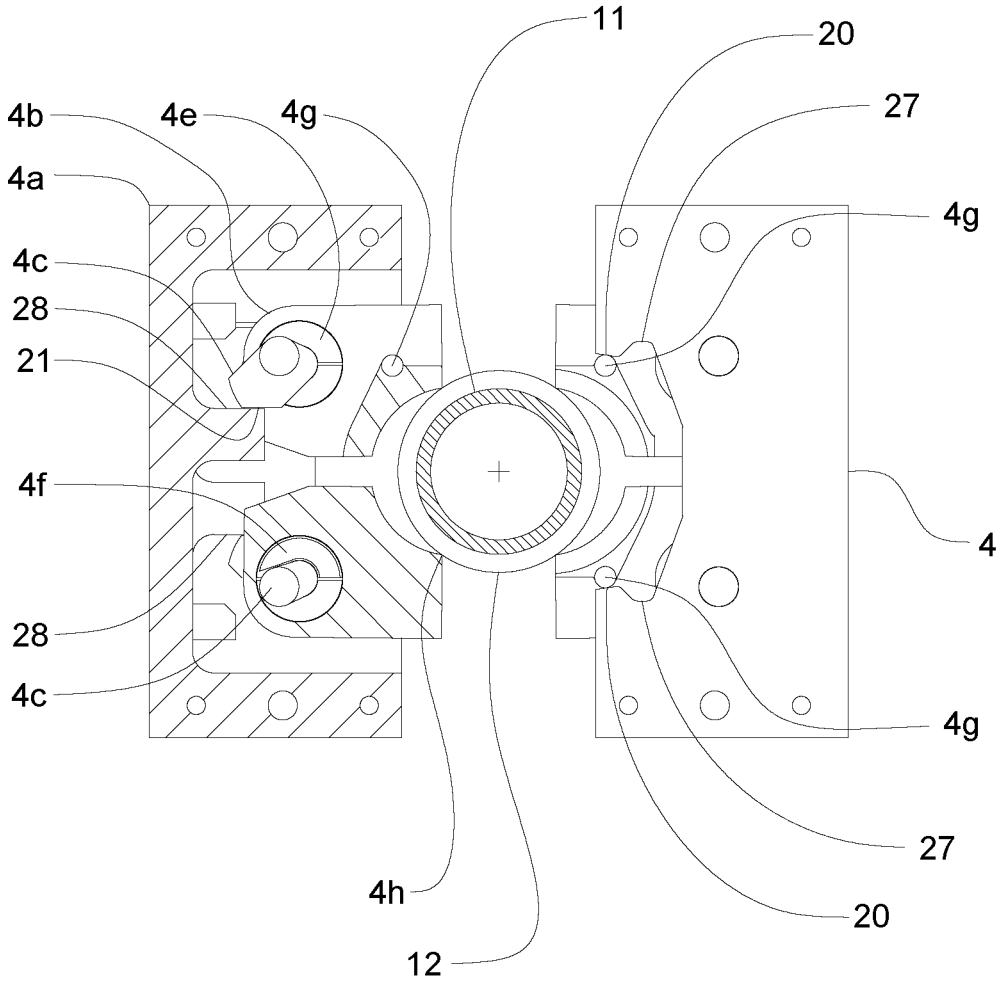
FIG. 9*b* is a top plan partial section view depicting the gripper block of the injector of FIG. 9*a* when the gripper block assembly starts to engage a tubing coupler.

FIG. 9*b* shows gripper assembly (4) in a position where the edges (4*h*) of gripper blocks (4*b*) contact coupler (12) as chain assemblies 110 begin to come together. It can be seen that guide pin (4*g*) can act as a pivot point for gripper block (4*b*) as it contacts surface (20) of gripper housing (4*a*) causing gripper block (4*b*) to rotate away from coupler (12).

Figure 9C:
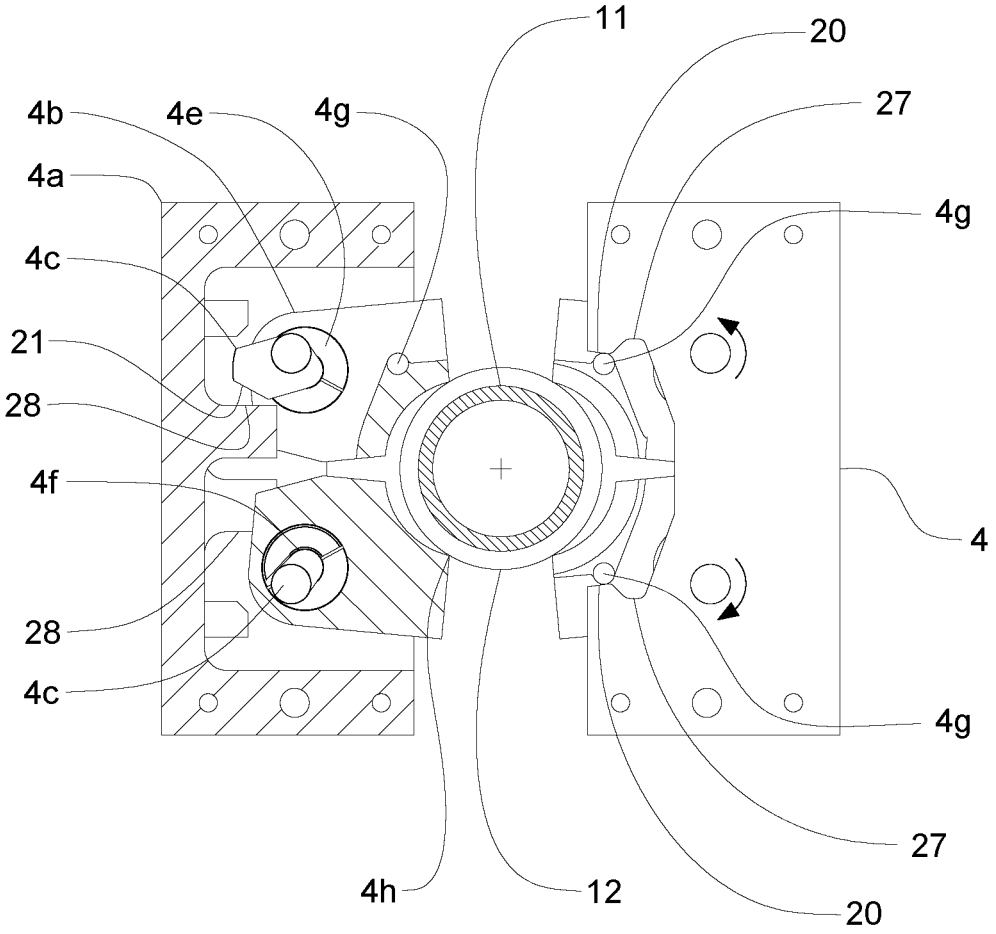
FIG. 9*c* is a top plan partial section view depicting the gripper block of the injector of FIG. 9*b* as the gripper block continues to engage the tubing coupler.

FIGS. 9*c* to 9*f* illustrate the progression of the various engagement modes between gripper block assembly (4) and coupler (12) as gripper block assemblies (4) progressively come together, thereby allowing gripper block assemblies (4*b*) to open variably and allow larger diameter elements such as couplers (12) to pass through chain assemblies 110 without interference. FIG. 9*c* illustrates gripper block assembly (4) closing further thereby causing gripper block assemblies (4*b*) to rotate outwards as it pivots around guide pin (4*g*) while engaging coupler (12). Guide pin (4*g*) can impede the outward rotation of gripper block assemblies (4*b*) by contacting surface (20) disposed on housing half (4*a*), therefore acting as a pivot point for rotation of gripper block (4*b*). Rotation around this pivot point can cause eccentric shaft (4*c*) to rotate and move gripping (4*b*) element outward, thereby creating clearance for coupler (12).

Figure 9D:
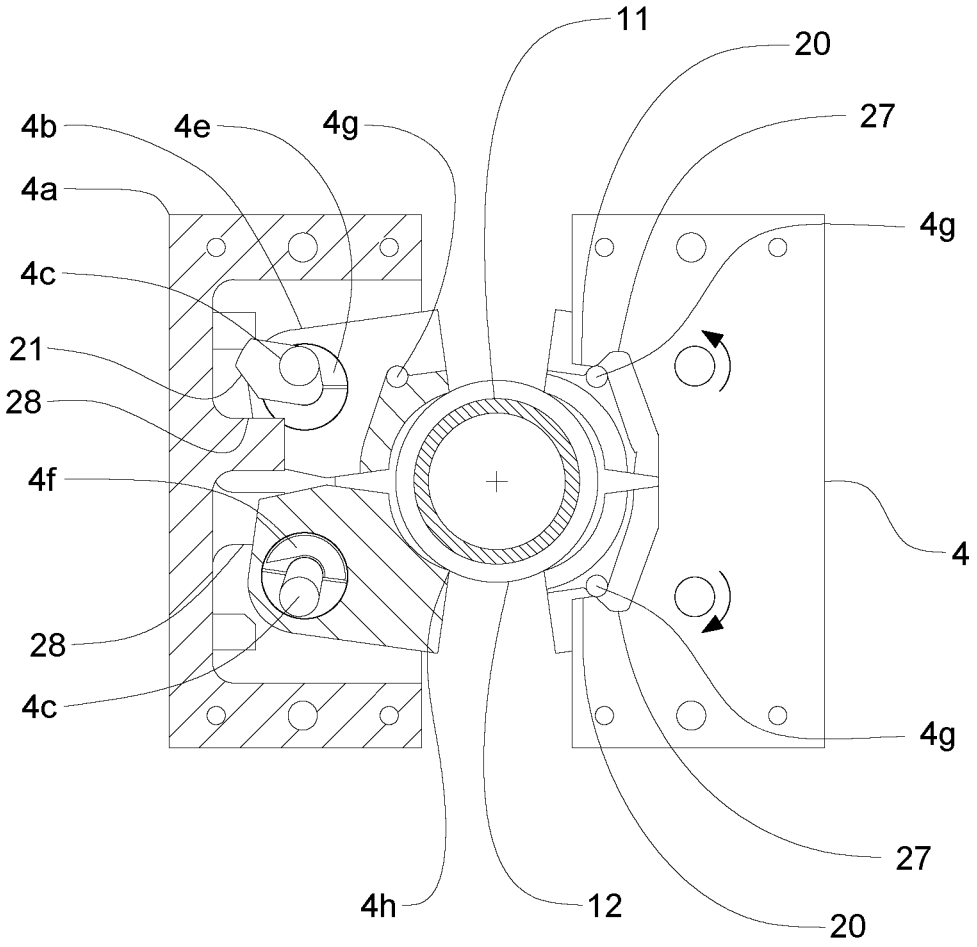
FIG. 9*d* is a top plan partial section view depicting the gripper block of the injector of FIG. 9*c* wherein the gripper block assembly is closing further on the tubing coupler.
Figure 9E:
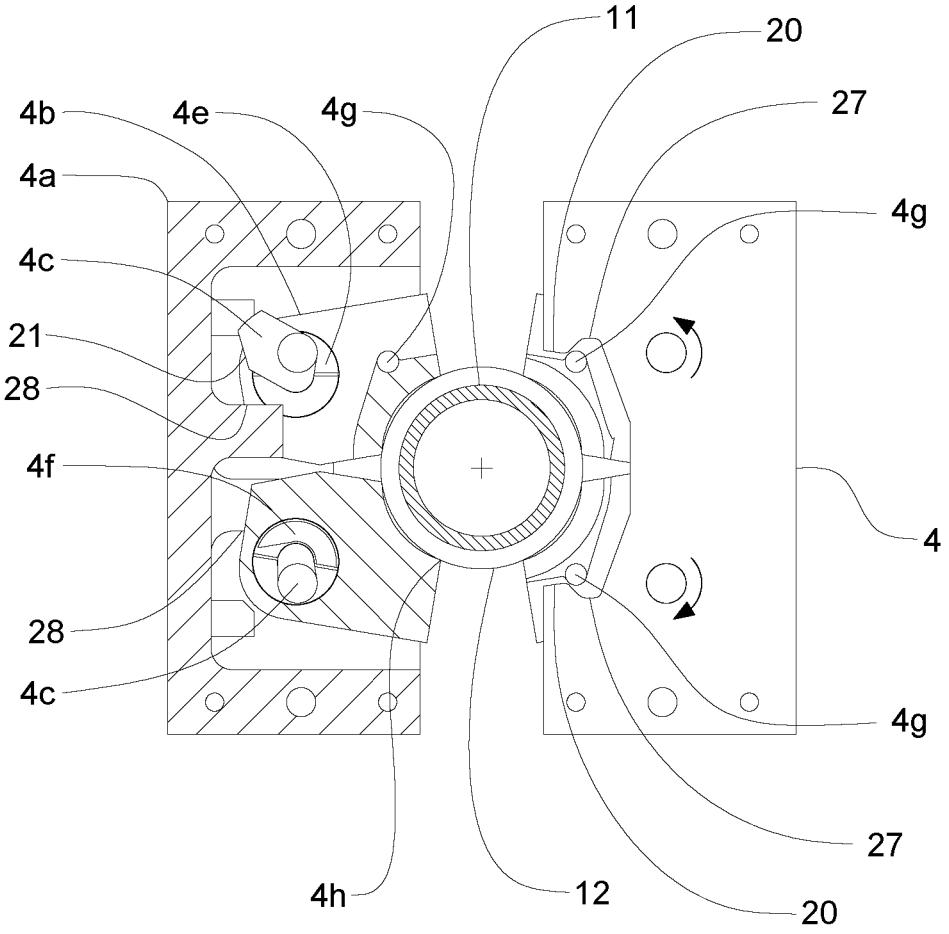
FIG. 9*e* is a top plan partial section view depicting the gripper block of the injector of FIG. 9*d* where the gripper block assembly is closing further still on the tubing coupler.
Figure 9F:
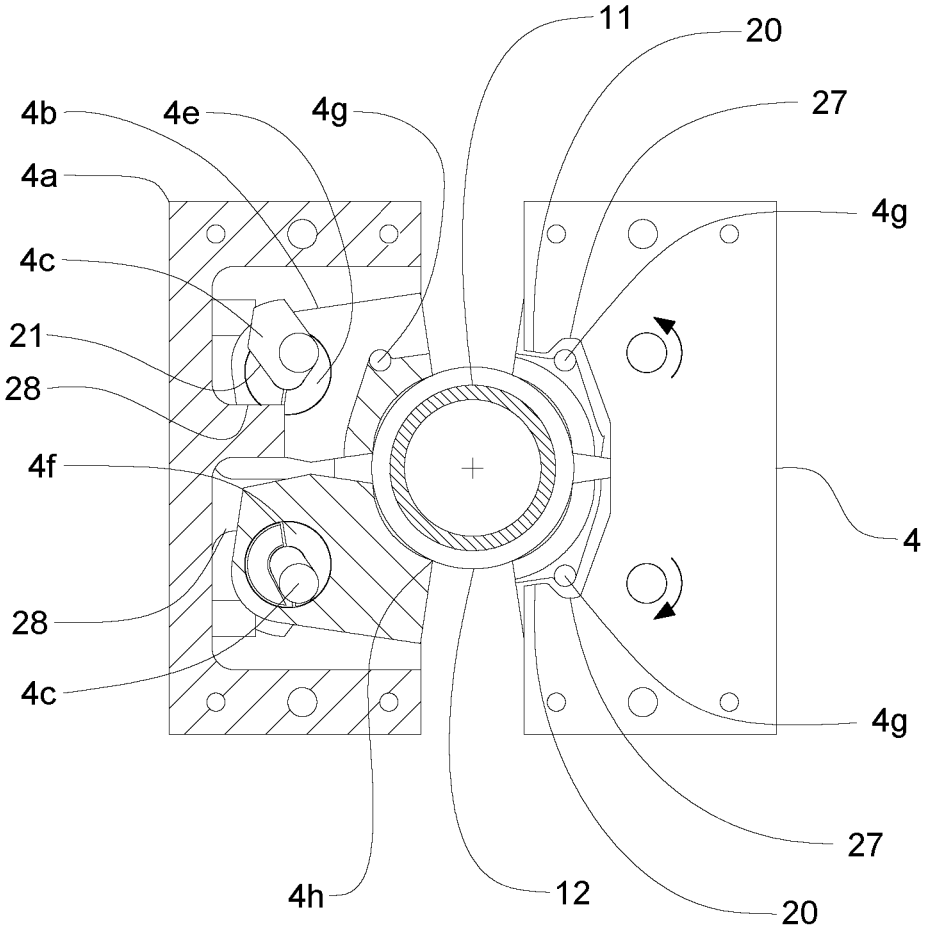
FIG. 9*f* is a top plan partial section view depicting the gripper block of the injector of FIG. 9*e* wherein the gripper block assembly has fully closed around the tubing coupler.

FIG. 9*d* illustrates still further closing of gripper block assembly (4) and the corresponding movement of gripper element (4*b*) and eccentric shaft (4*c*). As gripper blocks (4*b*) move back, guide pin (4*g*) reaches the end of surface (20) on the main housing (4*a*). FIG. 9*e* illustrates further progression to a position where gripper block assembly (4) has closed for a large amount and both leading edges (4*h*) of gripper blocks (4*b*) have made contact with coupler (12). In this figure, guide pin (4*g*) is no longer in contact with surface (20) on housing half (4*a*), thus, gripper element (4*b*) no longer rotates about guide pin (4*g*) but instead has its movement driven by the face of coupler (12) as guide pin (4*g*) moves into recess (27) disposed in main housing half (4*a*). In this embodiment, spring (4*f*) can prevent gripper blocks (4*b*) from moving further away from coupler (12) and can force gripper blocks (4*b*) towards tubing (11). Thus, the combination of surface (20) and recess (27) can provide or act as a "cam" profile for guide pins (4*g*) to follow along as gripper blocks (4*b*) move in and out of gripper block assemblies (4). FIG. 9*f* shows the final position of gripper block assemblies (4*b*) when gripper block assembly (4) has fully closed around tubing (11), demonstrating that gripper block assemblies (4*b*) have accommodated coupler (12).

Figure 10:
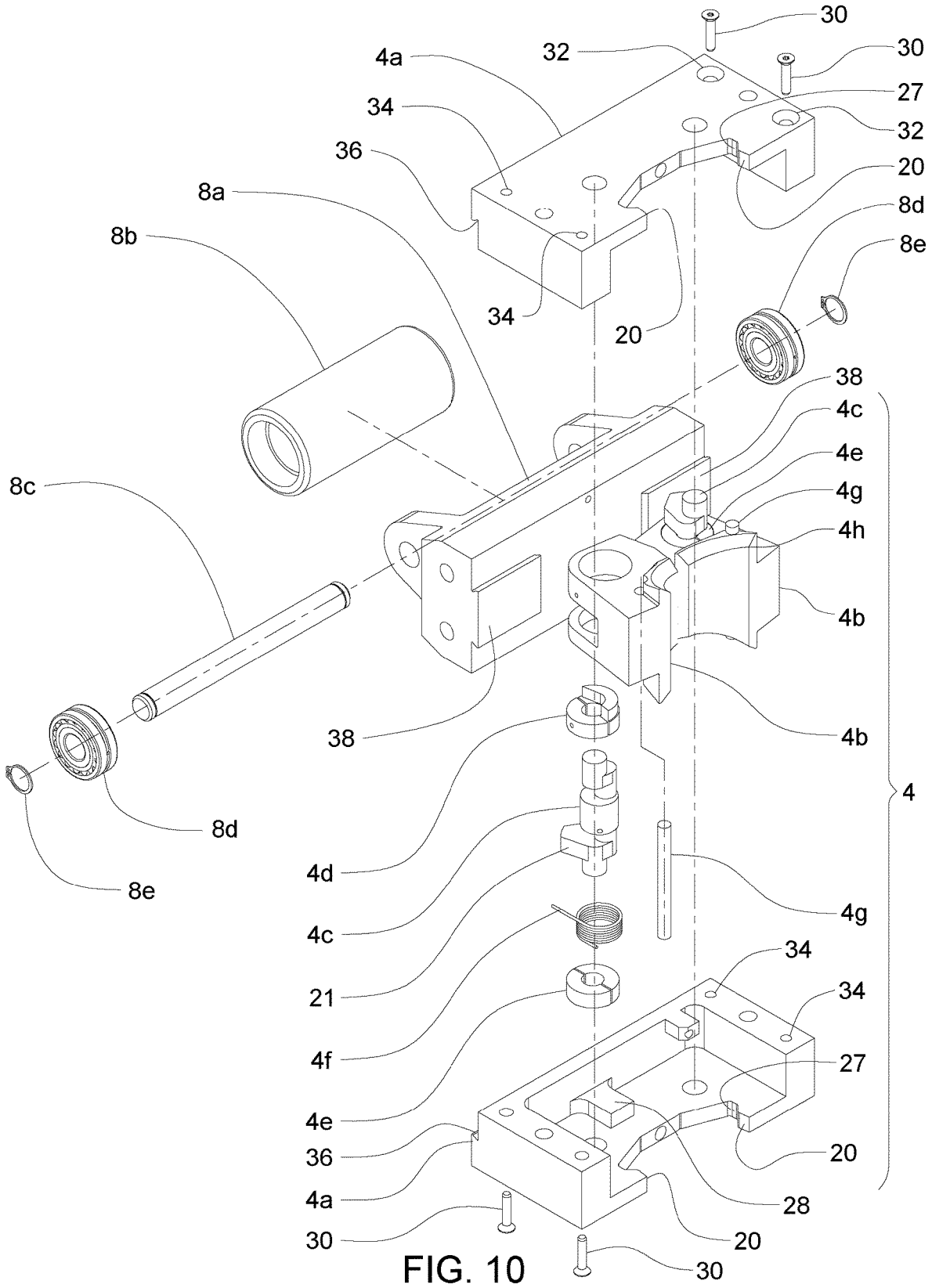
FIG. 10 is an exploded perspective view depicting a gripper block of the injector of FIG. 1*a*.

FIG. 10 shows an exploded view of the embodiment detailed in FIG. 8, showing the following elements: housing half (4*a*), gripper block (4*b*), eccentric shaft (4*c*), left bushing (4*d*) and right bushing (4*e*), spring (4*f*), guide pin (4*g*), outer corner (4*h*), carrier body (8*a*), roller (8*b*), shaft (8*c*), bearings (8*d*), retaining rings (8*e*) and surface (20) and recess (27). In some embodiments, housing halves (4*a*) can be assembled together by threaded fasteners (30) passing through holes 32 of one housing half (4*a*) to threadably engage threaded holes (34) in the other housing half (4*a*). In some embodiments, each housing half (4*a*) can comprise dovetail groove 36 such that dovetail slot (40) is formed when two housing halves (4*a*) are assembled together as shown in FIG. 11*b*.

Figure 11A:
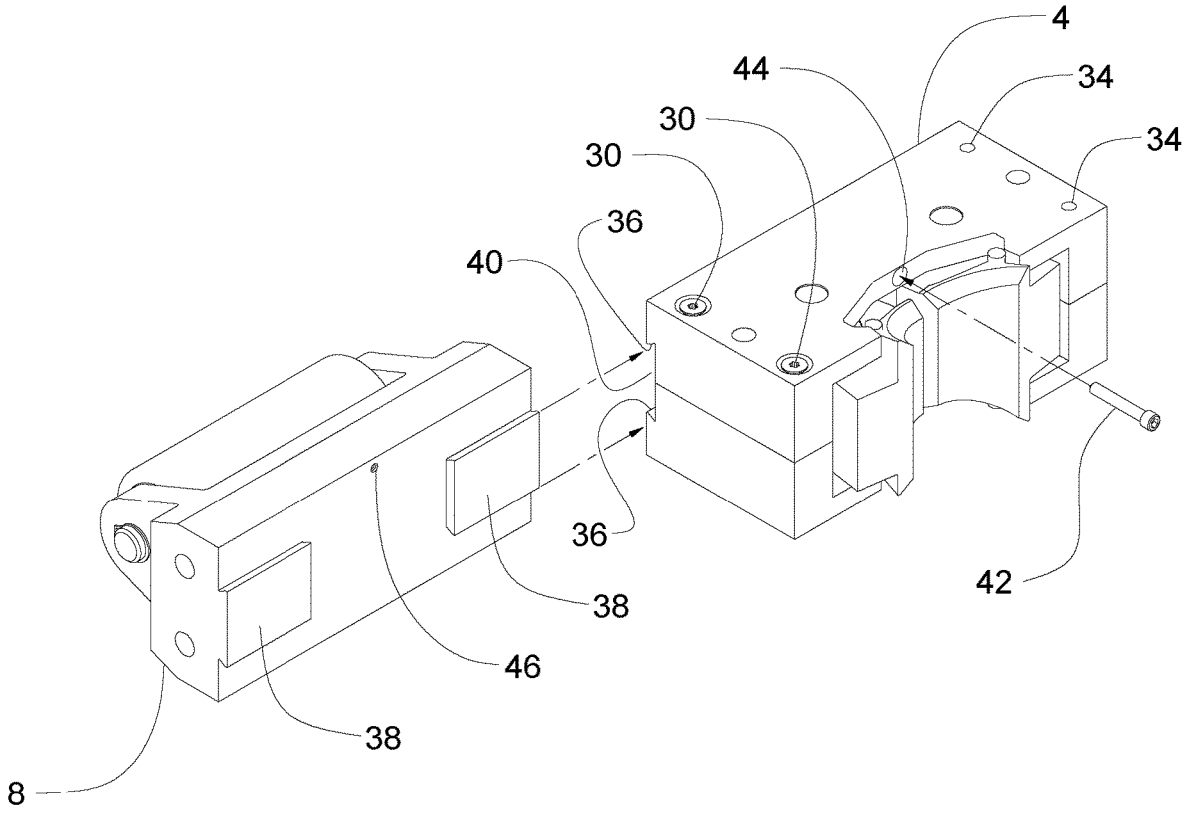
FIG. 11*a* is a front perspective view of the gripper block assembly of FIG. 10 illustrating the carrier assembly being assembled onto the gripper block housing halves.
Figure 11B:
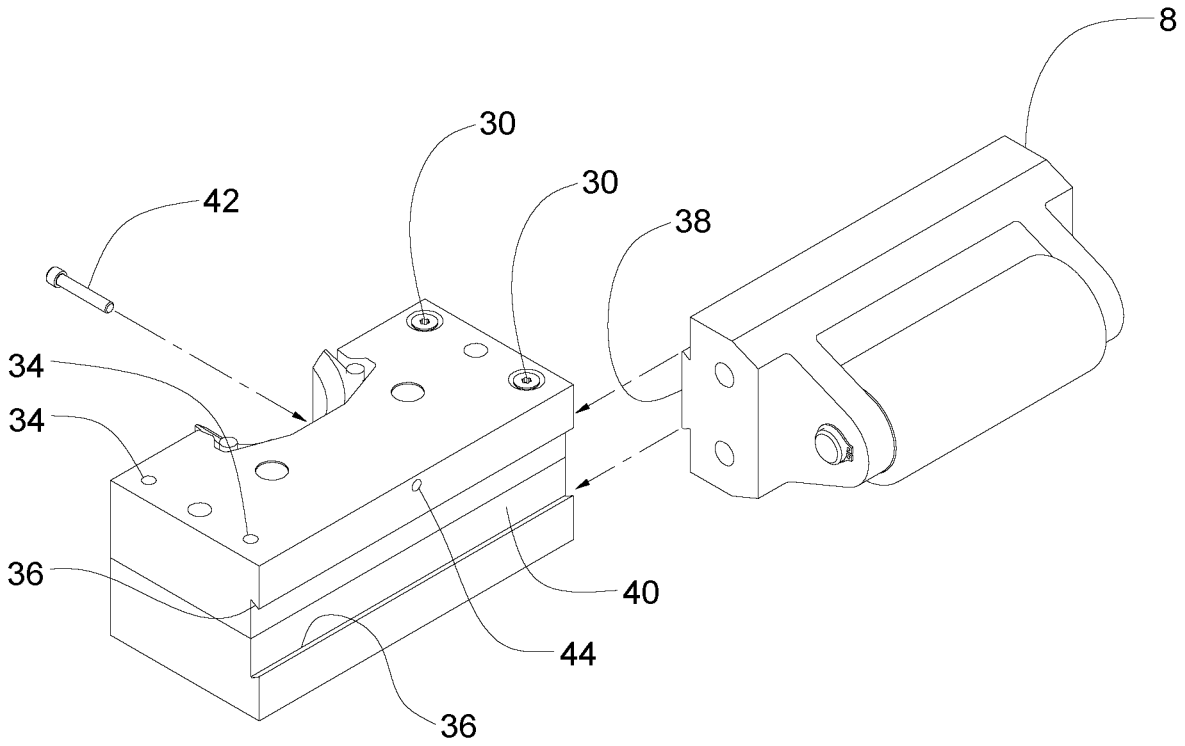
FIG. 11*b* is a rear perspective view of the gripper block assembly of FIG. 11*a* illustrating the carrier assembly being assembled onto the gripper block housing halves.
Figure 11C:
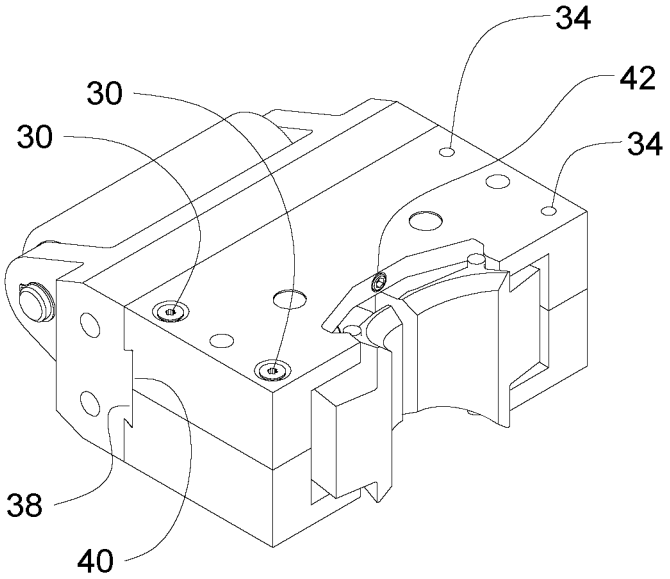
FIG. 11*c* is a front perspective view of the gripper block assembly of FIG. 11*a* after being assembled.

FIGS. 11*a* to 11*c* illustrate how gripper block assembly (4) can be assembled in some embodiments. In some embodiments, each housing half (4*a*) can comprise dovetail groove (36) that can form dovetail slot (40) when two housing halves (4*a*) are assembled together. Dovetail slot (40) can receive mating male dovetail profile (38) disposed on carrier assembly (8). When carrier dovetail profile (38) of assembly (8) is slid into dovetail slot (40) of gripper block assembly (4), threaded fastener (42) can be inserted through hole (44) disposed in gripper block assembly (4) to threadably engage threaded hole (46) disposed in carrier assembly (8). To remove gripper block assembly (4) from carrier assembly (8), either to replace a worn gripper block assembly (4) or to install different gripper block assemblies (4) configured to work with different sized tubing, threaded fastener (42) can be removed and gripper block assembly (4) can slide sideways until the dovetails are disengaged thereby freeing gripper block assembly (4) for removal.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A tubing injector for pushing or pulling a tubular string axially into or out of a well, the tubular string comprising a plurality of oil field tubulars connected together with tubular connecting elements, the tubular connecting elements having a larger diameter than the tubulars, the injector comprising:

a) a housing structure;

b) a plurality of gripper block assemblies attached to at least two drive chains, the at least two drive chains substantially parallel to each other and rotatably disposed in the housing structure, the plurality of gripper block assemblies configured to make contact with and apply force to the tubular string, wherein each of the plurality of gripper block assemblies comprises:

i) a pair of gripper blocks rotatably disposed in a housing further comprised of two housing halves, ii) a pair of eccentric shafts rotatably disposed in the housing wherein each of the pair of gripper blocks is rotatably disposed on an eccentric shaft, and iii) a spring disposed on each of the pair of eccentric shafts configured to bias each of the eccentric shafts to a starting position;

c) at least one motor operatively connected to the at least two drive chains, the at least two drive chains position in a spaced-apart configuration to create a passageway for the tubular string to pass therethrough;

d) at least two pressure plates or beams each operatively connected to at least two hydraulic cylinders, the at least two pressure plates or beams configured to impart a transverse force on the at least two drive chains when the at least two hydraulic cylinders are engaged thereby causing the plurality of gripper block assemblies to grip the tubular string; and e) a plurality of rolling elements disposed between the at least two drive chains and the at least two pressure plates, whereupon operation of the at least one hydraulic motor urges the at least two drive chains to move, thereby causing the tubular string to move axially into or out of the well when the plurality of gripper block assemblies are applying force to the tubular string.

2. The injector as set forth in claim 1, wherein the at least one motor comprises a hydraulic motor.

3. The injector as set forth in claim 2, wherein the at least one motor comprises one or more hydraulic motors operatively coupled to each of the at least two drive chains.

4. The injector as set forth in claim 1, wherein the housing structure is configured to translate a static axial force from an upper portion of the housing structure to a bottom mounting plate of the housing structure.

5. The injector as set forth in claim 4, wherein the gripper block assemblies are disposed in a gripper block assembly configured to impart radial and axial force to the tubulars and the tubular connecting elements.

6. The injector as set forth in claim 1, wherein the injector is mounted within an outer support structure comprising roller bearing elements, wherein the injector is configured to rotate with the tubular string.

7. The injector as set forth in claim 6, wherein the plurality of gripper block assemblies and the at least two drive chains are configured for passive rotation of the injector within the outer support structure.

8. The injector as set forth in claim 7, wherein the gripper block assemblies are disposed in a gripper block assembly configured to impart radial and axial force to the tubulars and the tubular connecting elements.

9. The injector as set forth in claim 6, wherein the gripper block assemblies are disposed in a gripper block assembly configured to impart radial and axial force to the tubulars and the tubular connecting elements.

10. The injector as set forth in claim 1, wherein the injector mounting structure is further mounted within an outer support structure housing that comprises a hydraulic rotary fluid swivel configured for the transfer of hydraulic fluids to the injector.

11. The injector as set forth in claim 10, wherein the outer support structure is configured to translate a static axial force from an upper portion of the outer support structure to a bottom mounting plate of the outer support structure.

12. The injector as set forth in claim 11, wherein the gripper block assemblies are disposed in a gripper block assembly configured to impart radial and axial force to the tubulars and the tubular connecting elements.

13. The injector as set forth in claim 10, wherein the gripper block assemblies are disposed in a gripper block assembly configured to impart radial and axial force to the tubulars and the tubular connecting elements.

14. The injector as set forth in claim 1, wherein the at least two hydraulic cylinders are configured to move the at least two pressure plates or beams towards and away from each other wherein the distance therebetween decreases and increases to accommodate the tubulars and the tubular connecting elements passing therethrough.

15. The injector as set forth in claim 14, wherein the gripper block assemblies are disposed in a gripper block assembly configured to impart radial and axial force to the tubulars and the tubular connecting elements.

16. The injector as set forth in claim 1, wherein the tubular connecting elements comprise one or both of tubular couplers and tool joints.

17. The injector as set forth in claim 1, wherein the gripper block assemblies are disposed in a gripper block assembly configured to impart radial and axial force to the tubulars and the tubular connecting elements.

18. The injector as set forth in claim 1, wherein each of the plurality of gripper block assemblies further comprises a guide pin disposed on each of the pair of gripper blocks, the guide pin configured to move along a cam profile disposed on each of the two housing halves.

19. The injector as set forth in claim 18, wherein each of the gripper block assemblies further comprises a stopper face disposed on each of the eccentric shafts and a stop disposed in each of the two housing halves, wherein the stopper face is configured to contact the stop.

20. The injector as set forth in claim 1, wherein each of the gripper block assemblies further comprises a stopper face disposed on each of the eccentric shafts and a stop disposed in each of the two housing halves, wherein the stopper face is configured to contact the stop.

* * * * *